US005790915A

United States Patent [19]

Arcaro et al.

[11] Patent Number: 5,790,915

[45] Date of Patent: Aug. 4, 1998

[54] PLANE REGISTRATION FOR MONOCHROME AND COLOR PRINTING SYSTEMS

[75] Inventors: David J. Arcaro, Boise; Wayne E. Foote, Eagle, both of Id.

[73] Assignee: Hewlett-Packard Company, Palo Alto, Calif.

[21] Appl. No.: 948,410

[22] Filed: Oct. 9, 1997

[51] Int. Cl.[6] ..... G03G 15/00

[52] U.S. Cl. ..... 399/2; 399/3; 399/139; 347/3

[58] Field of Search ..... 399/2–3, 139; 347/2–4

[56] References Cited

U.S. PATENT DOCUMENTS

| | | | |
|---|---|---|---|
| 4,734,868 | 3/1988 | DeLacy . | |
| 4,884,082 | 11/1989 | Sonoda et al. . | |
| 5,081,596 | 1/1992 | Vincent et al. . | |
| 5,089,712 | 2/1992 | Holland . | |
| 5,140,674 | 8/1992 | Anderson et al. . | |
| 5,321,467 | 6/1994 | Tanaka et al. . | |
| 5,570,451 | 10/1996 | Sakaizawa et al. . | |
| 5,592,262 | 1/1997 | Tanaka et al. . | |
| 5,729,785 | 3/1998 | Sakaizawa et al. | 399/2 |
| 5,734,390 | 3/1998 | Sakaizawa et al. | 347/2 |

FOREIGN PATENT DOCUMENTS

| | | |
|---|---|---|
| 08-048058 | 2/1996 | Japan . |
| 08-067033 | 3/1996 | Japan . |
| 08-095463 | 4/1996 | Japan . |
| 08-328325 | 12/1996 | Japan . |
| 09-136452 | 5/1997 | Japan . |

*Primary Examiner*—Matthew S. Smith

[57] ABSTRACT

A printing system for printing on a sheet of print media, the system including an electrophotographic printer operable to print on the sheet at a first print speed; and a color printer operable to print on the sheet of paper at a second print speed. The inkjet color printer includes a bidirectional sheet advancer operable to controllably move the sheet along an inkjet printer print path in either of first or second opposite directions, an inkjet pen carriage configured to support at least one inkjet pen and movable in a scan direction transverse to the inkjet printer print path for printing on the sheet, and a registration system operable to register a color image to be printed by the inkjet color printer relative to the black image printed by the electrophotographic printer. The registration system includes an optical sensor supported by the inkjet pen carriage for movement with the pen carriage along the scan direction.

20 Claims, 6 Drawing Sheets

PLANE REGISTRATION FOR MONOCHROME AND COLOR PRINTING SYSTEMS

FIELD OF THE INVENTION

The invention relates generally to printing systems. More particularly, the invention relates to monochrome and graphics printing systems. The invention also relates to printing registration.

BACKGROUND OF THE INVENTION

Monochrome and color image printing systems are known in the art. See, for example, commonly assigned U.S. Pat. No. 5,140,674 issued to Anderson et al. (incorporated herein by reference), and commonly assigned U.S. Pat. No. 5,081,596 issued to Vincent et al. (incorporated herein by reference). These patents disclose the combination of a color printer for printing graphics, with a monochrome (e.g., black) electrophotographic printer. The color printer prints color images incrementally, and the electrophotographic printer prints continuously. The color printer can be of the inkjet type, and the electrophotographic printer can be of the laser type.

An advantage of combining a color printer with an electrophotographic printer is that the resulting product has the combined advantages of low cost and high quality text printing. Color laser printers are expensive, and other types of color printers, such as inkjet printers, are often satisfactory for printing color graphics images, for certain business applications. On the other hand, inkjet printers sometimes do not produce sufficient text quality for business applications. Inkjet printers are less complex, and therefore less expensive than laser or electrophotographic printers, but do not always provide the line acuity and speed necessary for producing document quality text for a business application. Color printers of the laser or electrophotographic type require complex and expensive mechanisms to form and align color frames. Therefore, the combination of a color printer of the inkjet type to print color images incrementally, with a printer of the laser or electrophotographic type to print text images continuously, results in a good compromise low cost, high speed printer that can both print high quality text as well as high quality color graphics.

One of the biggest problems in commercially producing a hybrid printer of this type relates to obtaining registration between a plane defined by the monochrome (typically black) image printed by the laser or electrophotographic printer, and planes produced by a different print mechanism; namely, the color printer. A further challenge is obtaining registration in a cost effective manner in a device for which it is an object to reduce cost.

One way to deal with the problem of registration in a hybrid printing system is to avoid the issue by causing the color printer to print using process black (a combination of cyan, magenta, and yellow), where black is requested, in any areas of a page where black and color are to be mixed. Process black does not have the same quality as black printed by an electrophotographic or laser or printer, and, further, does not have the same darkness as regular black ink printed by a laser or electrophotographic printer, or an inkjet printer.

Therefore, there exists a need for a low cost system for registering images printed by an inkjet printer with images, such as text or graphics, printed by an electrophotographic printer in a low cost, high speed printer that prints high quality color graphics as well as high quality black text and graphics.

SUMMARY OF THE INVENTION

The invention provides a printing system for printing on a sheet of print media. The system includes an electrophotographic printer configured to print monochrome images on the sheet, and an inkjet color printer configured to print color images on the sheet. The inkjet color printer further includes a bidirectional sheet advancement system configured to controllably move the sheet along an inkjet printer print path in either of first and second directions. The inkjet color printer further includes an inkjet pen carriage configured to support at least one inkjet pen and movable along a scan direction for printing on the sheet, and a registration system configured to register graphics printed by the inkjet color printer relative to image printed by the electrophotographic printer. The registration system includes an optical sensor supported relative to the inkjet pen carriage for movement with the pen carriage along the scan direction.

In one aspect of the invention, a common housing supports both the electrophotographic printer and the inkjet printer.

In another aspect of the invention, the electrophotographic printer is a laser printer.

In another aspect of the invention, the optical sensor is a linear array optical sensor.

In another aspect of the invention, the electrophotographic printer prints a registration mark on the sheet, and the registration system uses the optical scanner to locate the registration mark and effect registration. The registration system causes the inkjet pen carriage to move in the scan direction and causes the sheet advancement system to move the sheet in the inkjet paper path direction until the registration mark is located using the optical sensor, prior to printing by the inkjet printer.

In one aspect of the invention, the color printer prints with incremental motion and the black printer prints with continuous motion.

Another aspect of the invention provides a method of printing on a sheet of print media. The method comprises printing an image and a registration mark on the sheet with a laser printer, and directing the sheet to a staging tray after the printing with the laser printer. The image on the sheet is registered in an inkjet color printer that uses a bidirectional sheet feeder to transport the sheet from the staging tray after the sheet has been printed on by the laser printer. The registration includes using an optical sensor movable with an inkjet pen carriage, and causing the carriage to move and causing the bidirectional sheet feeder to move until the registration mark is located. A color image is printed on the sheet by the inkjet printer after registering the image printed by the laser printer.

DESCRIPTION OF THE DRAWINGS

Preferred embodiments of the invention are described below with reference to the following accompanying drawings depicting examples embodying the best mode for practicing the invention.

FIG. 4 is a perspective view of an inkjet pen carriage included in the printing system of FIG. 1.

FIG. 8 is a sectional elevation schematic view of a printing system in accordance with an alternative embodiment of the invention.

DETAILED DESCRIPTION OF THE INVENTION

This disclosure of the invention is submitted in furtherance of the constitutional purposes of the U.S. Patent Laws "to promote the progress of science and useful arts". U.S. Constitution, Article 1, Section 8.

Figure 1:
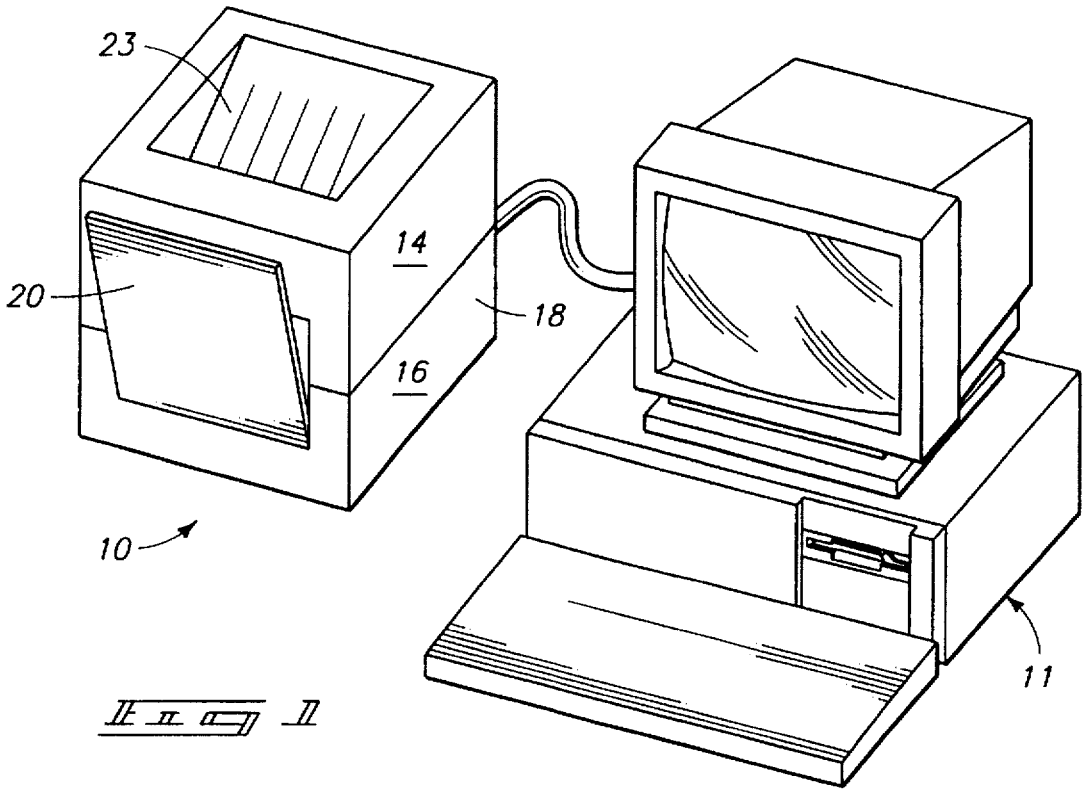
FIG. 1 is a perspective view of a printing system in accordance with one embodiment of the invention coupled with a computer.
Figure 3:
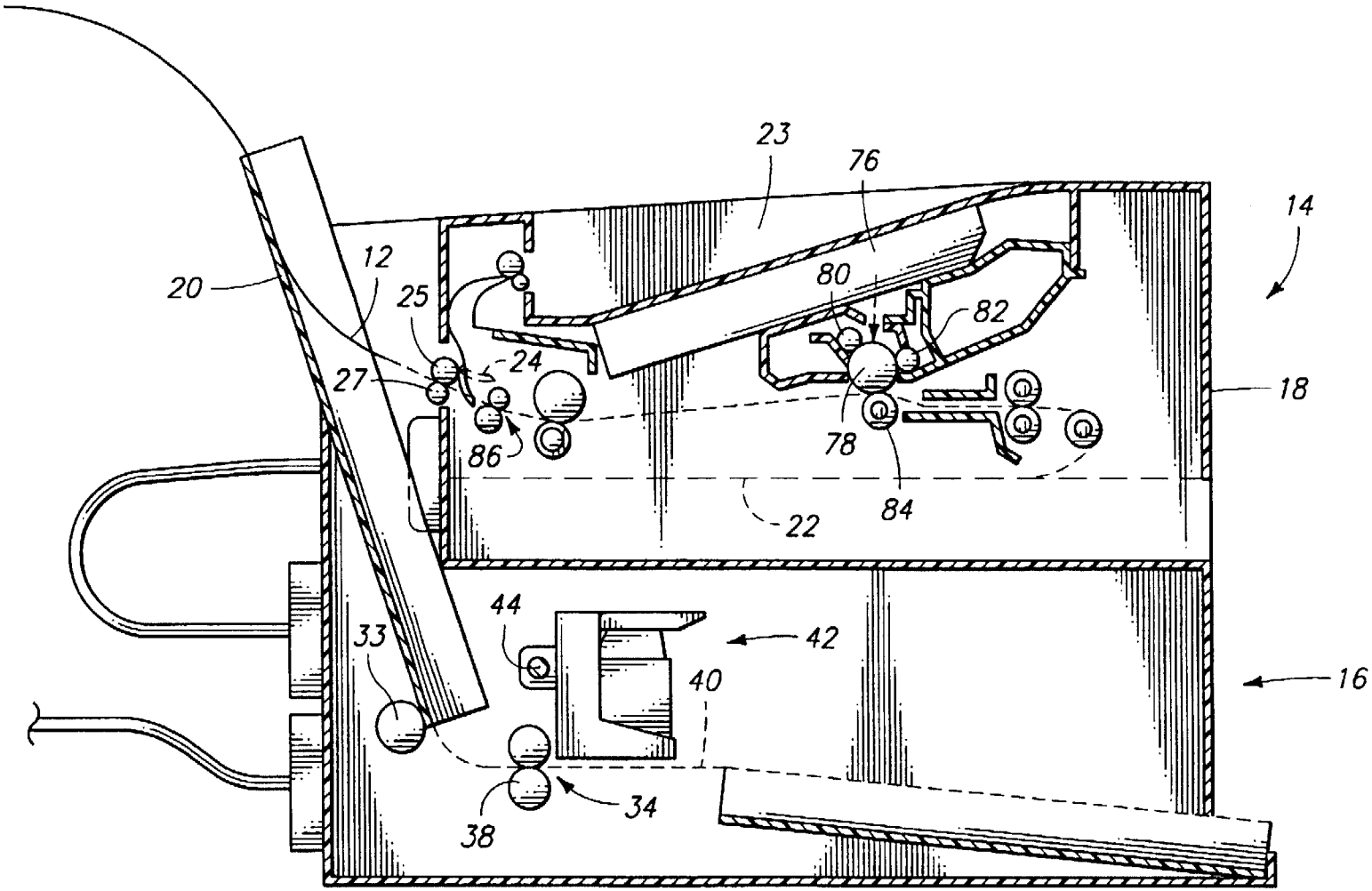
FIG. 3 is a sectional elevation schematic view of the printing system of FIG. 1.
Figure 3:
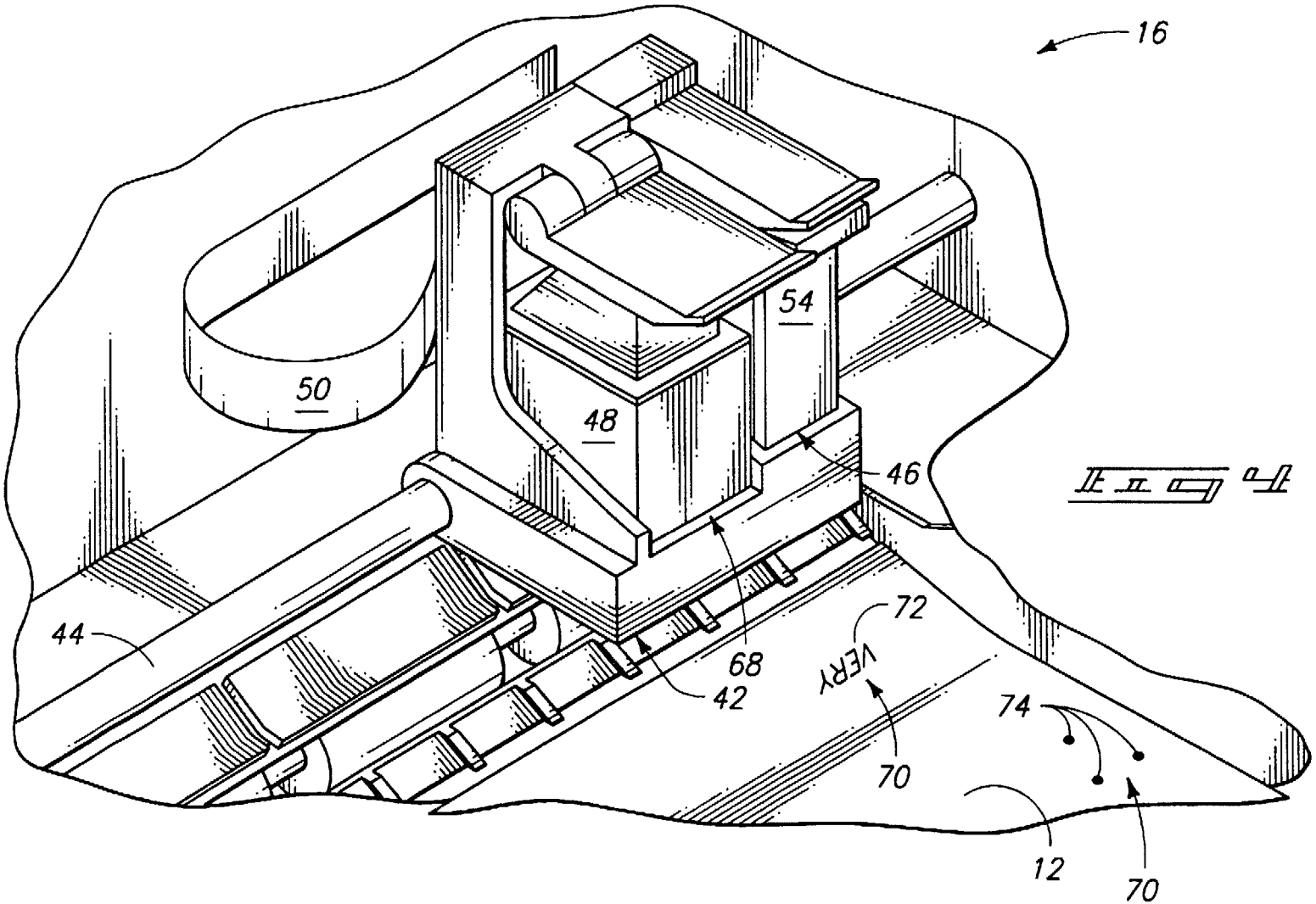

FIG. 1 shows a printing system 10, embodying the invention, for printing on a sheet or page 12 (FIG. 3) of print media. The printing system 10 is connected for control by a microprocessor based computer 11. The system 10 includes an electrophotographic printer 14 configured to print a monochrome image on the sheet (e.g., including text and/or graphics), and an inkjet printer 16 configured to print a color image on the sheet (e.g., including color graphics). The term image means text, graphics, or both text and graphics. The term monochrome means a single color, which will usually be black. In the illustrated embodiment, the printer 16 prints with incremental motion and the printer 14 prints with continuous motion. More particularly, in the illustrated embodiment, the printer 14 is a laser printer, and the printer 16 is a multi-color inkjet printer 16. As such, laser printer 14 is configured to print at up to a first maximum speed with respect to pages per minute and the inkjet printer 16 is configured to print at up to a second maximum speed with respect to pages per minute. Although typically these maximum speeds are different, they may be the same. In one embodiment, the printer 14 includes internal components similar to those found in a LaserJet 6p printer sold by Hewlett-Packard Company of Palo Alto, Calif., and the DeskJet printer 16 includes internal components similar to those found in a DeskJet 720 printer sold by Hewlett-Packard Company of Palo Alto, Calif., except modified as described below. The system 10 includes a housing 18 supporting the printer 14 above the printer 16 in the illustrated embodiment. In the illustrated embodiment, the printer 14 includes a laser scanner 76 supported in the housing 18, a toner supply (not shown), a photoconductor roller 78 acted on by the laser scanner 76, a charge roller 80 imparting charges to the photoconductor roller 78 upstream of where the laser scanner 76 acts on the photoconductor roller 78, a developer roller 82 acting on the photoconductor roller 78 downstream from where the laser scanner 76 acts on the photoconductor roller 78, a transfer roller 84 facing the photoconductor roller 78 downstream from the developer roller 82 and cooperating with the photoconductor roller 78 to impart an image to the sheet, a cleaning blade cleaning the photoconductor roller 78 after the image has been imparted to the sheet, and a fuser 86 spaced apart from and downstream from the photoconductor roller 78.

The printing system 10 further includes a staging tray 20 which functions both as an output tray to receive the sheet after the sheet has been printed on by the printer 14, as well as an input tray to supply the sheet that has been printed on by the printer 14, or a fresh unprinted sheet, to the printer 16 before the printer 16 prints on the sheet. The staging tray 20 decouples the variable process speed of the laser printer from the variable process speed of the inkjet printer. The printer 14 can selectively receive sheets of print media from a tray 22 (FIG. 3), or from an individual sheet feed area, as is known in the art.

In one embodiment, the printer 14 further includes another output tray 23, and can selectively send printed media to either the staging tray or to the output tray 23 (e.g.; the printer 14 includes a solenoid actuated, pivotally mounted, paper redirection guide 24 directing the printed media to either the output tray 23 or the staging tray 20). For example, if the interpreter 28 determines that a particular sheet or set of sheets will not have any color image, that sheet or set of sheets can be directed to the output tray 23 after having a black image printed by the printer 14, while other sheets or sets of sheets can be directed to the staging tray.

Figure 2:
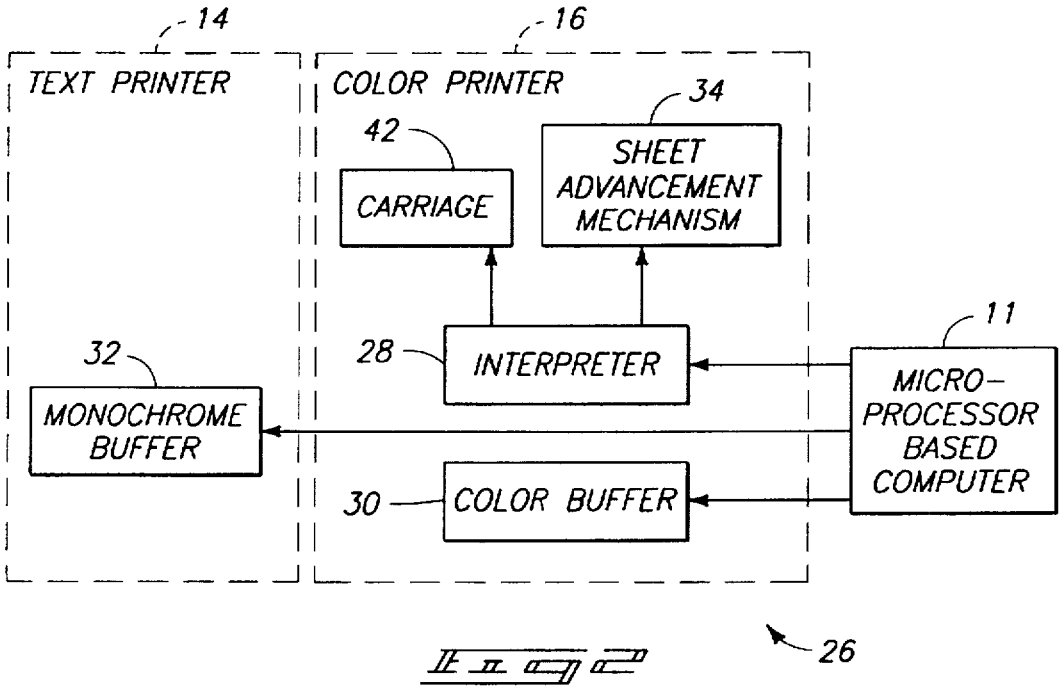
FIG. 2 is a schematic diagram of a control system for controlling the printing system of FIG. 1.

The printing system 10 further includes a control system 26 (FIG. 2). The control system 26 includes a data storage buffer 30 for the printer 16, and a data storage buffer 32 for the printer 14, in the housing. The control system 26 further includes an interpreter or formatter 28 which receives data from the computer. The computer 11 is connected to the buffer 30 for the printer 16 and to the buffer 32 for the printer 14. The computer 11 segregates the data into black and color components. Normally, such segregation is accomplished by reading printer command language (PCL) or postscript commands generated in the computer 11 when printing data blocks of black and color. Typically, each block of data is normally preceded by a command header that designates the size and data type of the block. After data is segregated, the computer 11 directs color components to the buffer 30 for the color printer 16 and directs the monochrome components to the buffer 32 for the printer 14. In an alternative embodiment, the segregation is performed by the interpreter 28. In the illustrated embodiment, the buffer 30 is in the printer 16, and the buffer 32 is in the printer 14; however, placement anywhere in the common housing is possible. After segregation, the monochrome and color data are used by the printer 14 and the printer 16, respectively.

In the illustrated embodiment, the computer 11 can be connected to a single parallel port connector for the entire printer system 10.

The printer 16 includes a feed mechanism, having a feed roller 33, for separating a single sheet from a stack of sheets in the staging tray and feeding the single sheet into the printer 16 for printing. The printer 16 further includes a bidirectional sheet advancement system or mechanism 34, including an advancement roller 38 (FIG. 3) controlled by the interpreter 28. The bidirectional sheet advancement system 34 is substantially similar to the bidirectional capable sheet advancement system included in the Hewlett Packard DeskJet 720 printer. Though the DeskJet 720 does not perform bidirectional sheet advancement, it has an encoder on its paper shaft so is capable of bidirectional sheet advancement.

In the illustrated embodiment, the bidirectional sheet advancement system 34 controllably moves the sheet along an inkjet printer print path 40 in either of a first direction away from the staging tray 20 (into the printer 16), or a second direction toward the staging tray (back out of the printer 16). Sheet movement along the paper path is monitored by an encoder (not shown), so the interpreter 28 knows the position of the sheet along the paper path in the printer 16.

The printer 16 further includes an inkjet pen carriage 42 (FIGS. 2 and 4) including a chamber 46 for removably closely receiving at least one color inkjet pen 48. The carriage 42 is slidably mounted on a rod 44 for movement therealong in a scan direction perpendicular to the print path 40, for printing on the sheet. The inkjet pen 48 is a conventional color print cartridge, such as a C1823A Print Cartridge sold by Hewlett-Packard Company of Palo Alto, Calif. The printer 16 includes a flexible ribbon cable 50 electrically coupling the inkjet pen 48 to the buffer 30 and the interpreter 28. The interpreter 28 converts the PCL commands to a bit map such that the color image in the buffer 30 is converted to color dots which are printed by the inkjet pen 48. Movement of the inkjet pen carriage 42, and thus movement of the inkjet pen 48, is controlled by the interpreter 28.

Figure 5:
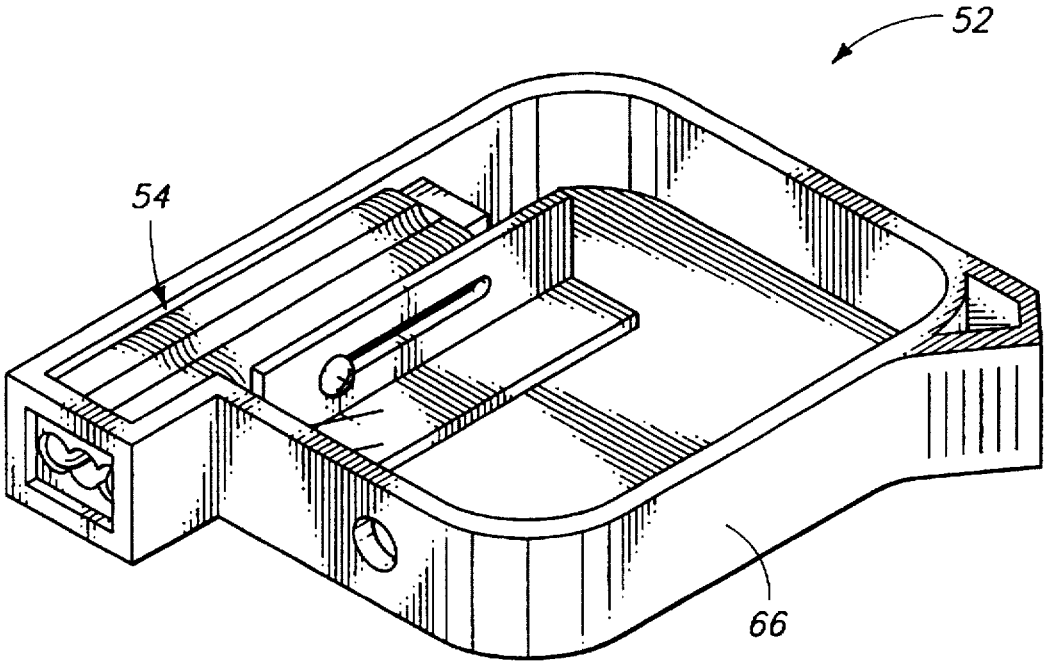
FIG. 5 is a perspective view of a cartridge, received in the carriage of FIG. 4, and including an optical sensor assembly.
Figure 6:
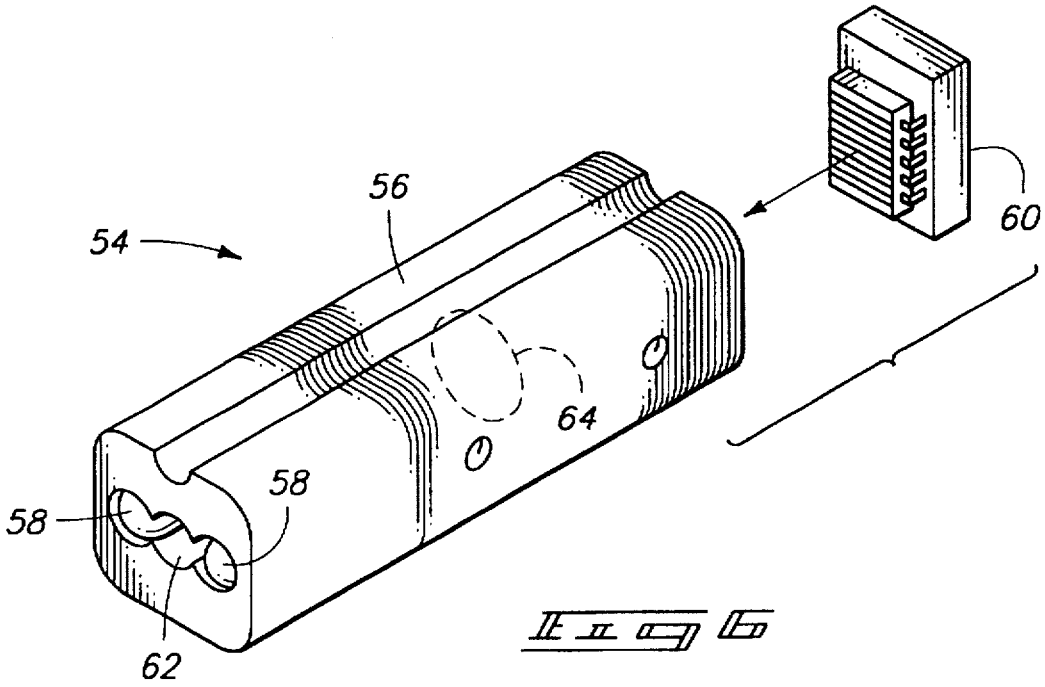
FIG. 6 is an exploded perspective view of the optical sensor assembly of FIG. 5.

The printer 16 further includes a registration system 52 which registers an image printed by the printer 16 relative to image printed by the printer 14. The registration system 52 includes the interpreter 28. The registration system 52 further includes an optical sensor assembly 54 supported relative to the inkjet pen carriage 42 for movement with the pen carriage 42 along the scan direction. In the illustrated embodiment, the sensor assembly 54 comprises an elongated sensor housing 56, a pair of illumination light emitting diodes 58 on one end of the sensor assembly 54 for facing the print media, and a charge coupled device (CCD) linear array 60 mounted on the other end of the sensor housing 56. The linear array 60 also faces the paper via an aperture 62 between the light emitting diodes 58. The aperture 62 extends to the array 60. A lens 64 is mounted in the aperture approximately mid-way between the two ends of the sensor housing 56. In the illustrated embodiment, the lens has a focal length of 20 mm, and yields 80 mm between the sheet and the array 60. In the illustrated embodiment, the sensor assembly 54 is mounted in an empty ink cartridge 66 (FIG. 5) for placement in a chamber 68 (FIG. 4) of the inkjet pen carriage 42 where a black ink cartridge would normally be placed. However, because black ink is printed by the printer 14, the black ink cartridge is omitted in the illustrated embodiment. In one embodiment, the linear array 60 is not mounted in a cartridge, but instead is supported by the carriage 42 (e.g., adjacent the color ink cartridge) for movement with the carriage 42. Thus, the chamber 68 can either be omitted, or a black ink cartridge can be provided. The linear array 60 is coupled to the interpreter 28 by the flexible ribbon connector 50.

The printer 14 prints a registration mark 70 on the sheet, and the registration system 52 uses the linear array 60 to locate the registration mark and effect registration. The registration system 52 causes the inkjet pen carriage 42 to move in the scan direction and causes the sheet advancement system 32 to move the sheet in the inkjet paper path direction until the registration mark 70 is located using the linear array 60, prior to printing by the printer 16.

In one embodiment of the invention, the registration system 52 registers on text characters intermingled with other characters, such as the letter "v" 72. In another embodiment, the registration mark 70 comprises a series of dots 74 that define a pattern which is recognizable by the registration system 52, but which cannot be easily seen by the human eye.

By taking advantage of the scan motion of the carriage, and the bi-directional sheet advancement mechanism 34, the single linear array 60 can scan any area on the black plane pre-printed by the printer 14. This produces a cost savings compared with an alternative embodiment in which multiple arrays are employed across the width of the sheet. Scan information is sent to the interpreter 28 for on-the-fly registration correction. In an alternative embodiment, the scan information is sent to the computer 11 through a bidirectional parallel port, and the computer 11 performs the registration correction. After the correction is made, the sheet is positioned back to top-of-form, and color printing begins.

Figure 7:
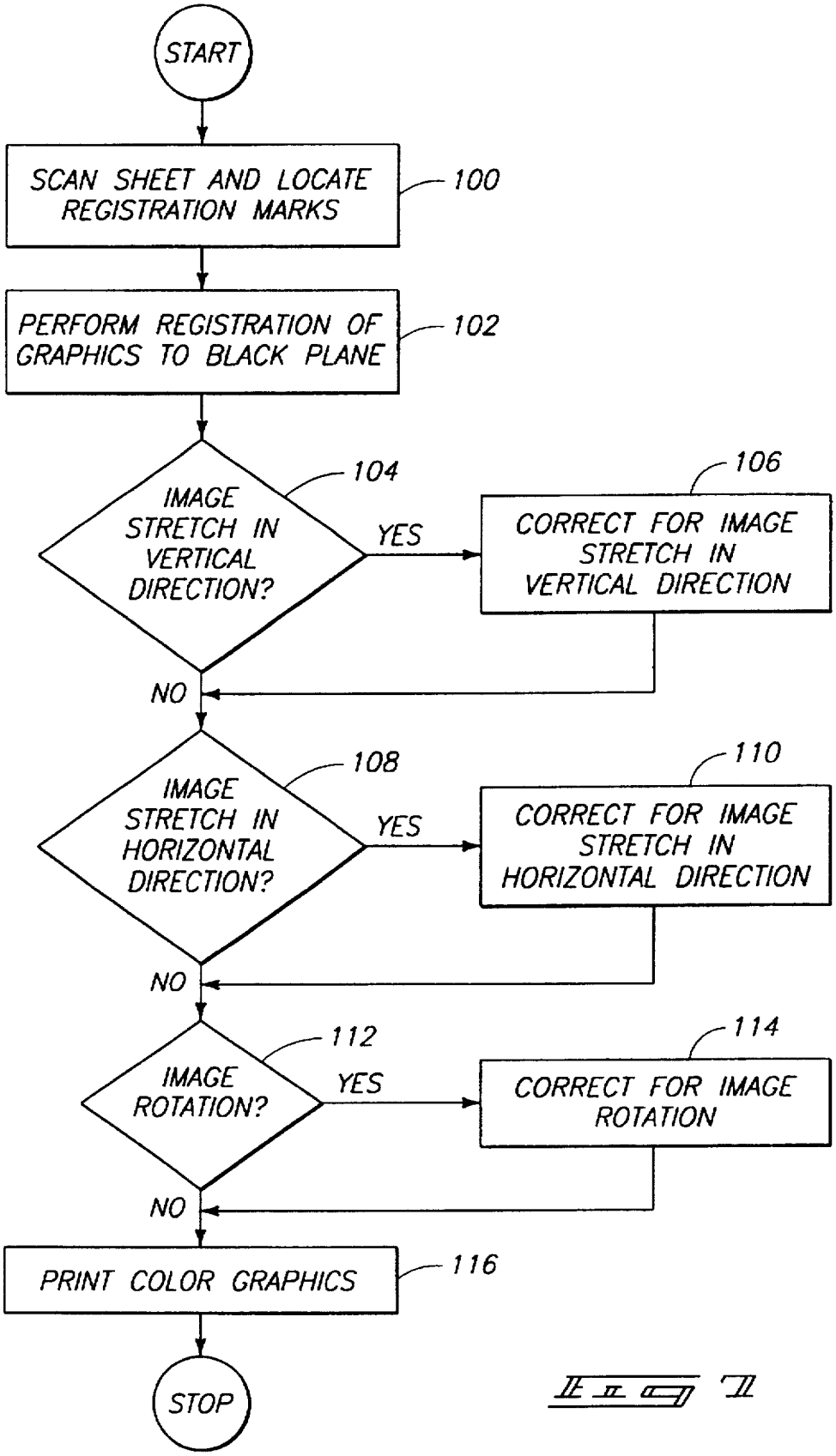
FIG. 7 is a flow chart illustrating logic employed by a registration system included in the printing system of FIG. 1.
Figure 6:
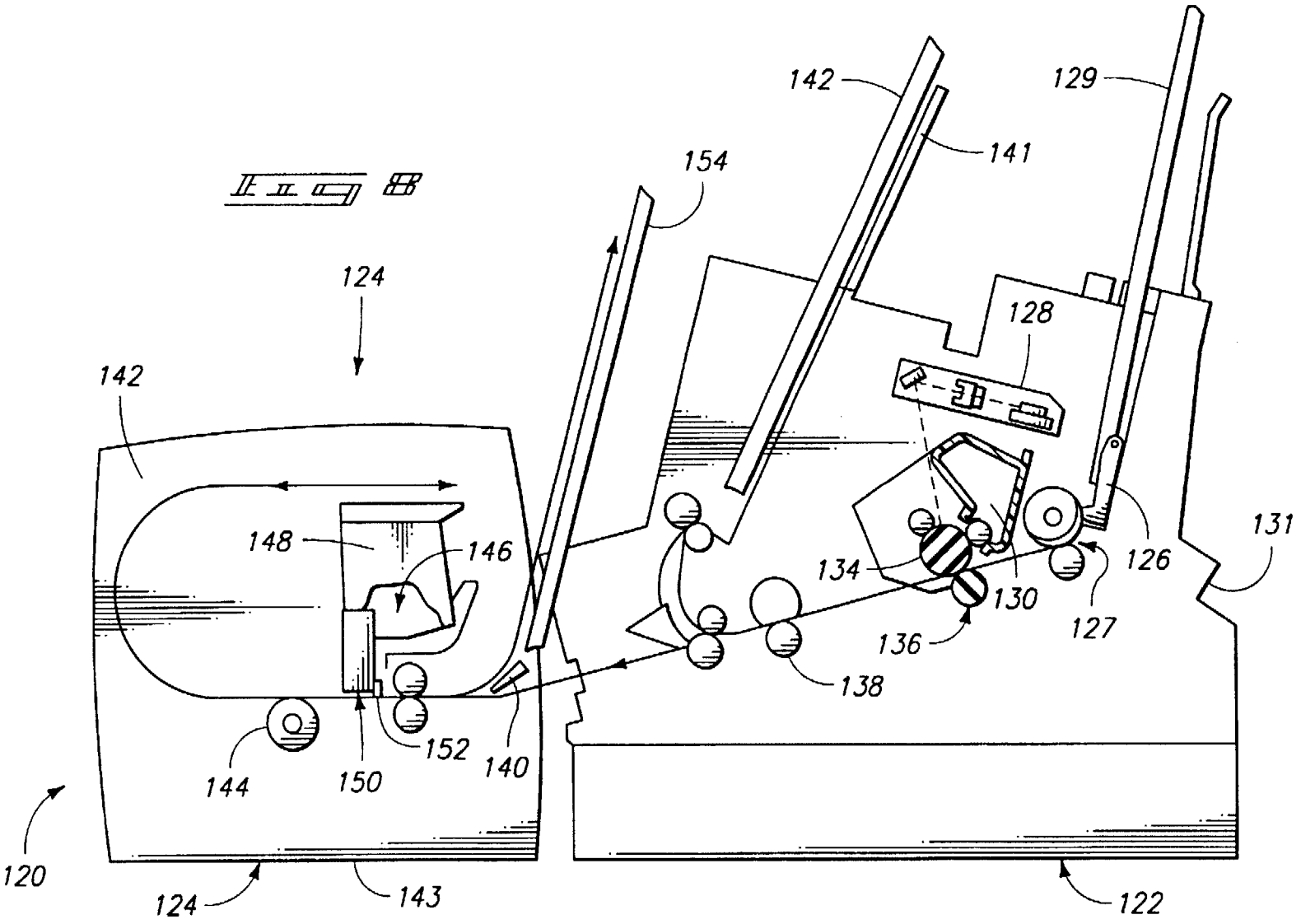

FIG. 7 is a flow chart illustrating logic employed by the registration system 52.

In a step 100, the registration system scans a sheet printed by the printer 14 for registration marks 72. After performing step 100, the registration system proceeds to step 102.

In step 102, the registration system registers an image to be printed by the printer 16 with the monochrome plane printed by the printer 14. After performing step 102, the registration system proceeds to step 104.

In step 104, a determination is made as to whether the image printed by the printer 14 is stretched or compressed in the vertical direction (along the inkjet print path) with respect to the image intended to be printed by the printer 14. If so, the registration system proceeds to step 106; if not, the registration system proceeds to step 108.

In step 106, the registration system corrects for image stretch or compression by the printer 14 in the vertical direction. In other words, the bitmaps for color images to be printed are vertically stretched or compressed to line up with the actual image printed by the printer 14. After performing step 106, the registration system proceeds to step 108.

In step 108, a determination is made as to whether the image printed by the printer 14 is stretched or compressed in the horizontal direction (normal to the inkjet print path) with respect to the intended image to be printed by the printer 14. If so, the registration system proceeds to step 110; if not, the registration system proceeds to step 112.

In step 110, the registration system corrects for image stretch or compression by the printer 14 in the horizontal direction. In other words, the bitmaps for the color images to be printed are horizontally stretched or compressed to line up with the actual image printed by the printer 14. After performing step 110, the registration system proceeds to step 112.

In step 112, a determination is made as to the angle (if any) at which the image printed by the printer 14 is rotated clockwise or counterclockwise with respect to the image intended to be printed by the printer 14. If so, the registration system proceeds to step 114; if not, the registration system proceeds to step 116.

In step 114, the registration system corrects for image rotation. In other words, the bitmaps for the color images to be printed are rotated clockwise or counterclockwise to line up with the actual image printed by the printer 14. After performing step 114, the registration system proceeds to step 116.

In step 116, the registered color image is printed on the sheet over the image printed by the printer 14.

FIG. 8 shows a printing system 120 in accordance with an alternative embodiment of the invention. The printing system 120 is connected for control by a microprocessor based computer. The system 120 includes a laser printer 122 configured to print a monochrome (typically black) image on a sheet of paper, and an inkjet color printer 124 configured to print a color image on the sheet. In the illustrated embodiment, the printer 124 prints with incremental motion and the printer 122 prints with continuous motion. More particularly, in the illustrated embodiment, the printer 124 is a multi-color inkjet printer. In the illustrated embodiment, the printer 122 includes an input paper tray 126 for supporting a stack of print media (e.g., paper) 129, and a pick assembly 127 for separating and feeding a sheet from the stack. The printer 122 further includes a housing 131 supporting a laser scanner 128, a toner supply 130, a photoconductor roller 134 acted on by the laser scanner 128, a transfer roller 136 facing the photoconductor roller 134 and cooperating with the photoconductor roller 134 to impart an image to the sheet, a fuser 138 spaced apart from and downstream from the photoconductor roller 134, and an output tray 141 for sheets 142 that only require printing of a black image.

The printer 124 has a pivotally movable, controlled, paper re-direction guide 140 which directs the sheet printed upon by the laser printer 122 into a paper motion area 142. The sheet enters the paper motion area 142 at the process speed of the laser printer 122. In the embodiment of FIG. 8, the staging tray is omitted. The inkjet color printer 124 further includes a bidirectional sheet advancement system or mechanism 143, including a paper drive roller 144 controlled by an interpreter in a manner similar to that for the embodiment of FIG. 3. In the illustrated embodiment, the bidirectional sheet advancement system controllably moves the sheet along an inkjet printer print path in the paper motion area 142 in either of a first direction toward the laser printer or a second direction away from the laser printer.

The printer 124 further includes an inkjet pen carriage 146 including a chamber for removably receiving at least one color inkjet pen 148. The carriage 146 is slidably mounted for movement in a scan direction perpendicular to the print path, for printing on the sheet. The inkjet pen 148 is a conventional color print cartridge. Movement of the inkjet pen carriage 146, and thus movement of the inkjet pen 148, is controlled by an interpreter.

The inkjet color printer 124 further includes a registration system 150 which registers graphics printed by the inkjet color printer 124 relative to text printed by the text printer 122. The registration system 150 further includes an optical sensor assembly 152 supported relative to the inkjet pen carriage 146 for movement with the pen carriage 146 along the scan direction. In the illustrated embodiment, the sensor assembly 152 is similar to the sensor assembly 54 described above and includes a charge coupled device (CCD) linear array.

A monochrome image is first printed on a sheet by the printer 122 and, if color is to be printed as well, the sheet enters a paper motion area of the printer 124 at the process speed for the printer 122. Scanning for registration marks by the sensor assembly 152 can take place while the paper enters at process speed for the printer 122, or can take place after the printer 122 completes delivery of a sheet into the printer 124. Color planes are then adjusted based on the scan by the sensor assembly 152, and printing takes place. The printer 124 further includes a color output tray 154 which receives the sheet after color printing. More particularly, the printed sheet is re-directed to the color output tray 154 by the redirection guide 140.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A printing system for printing on a sheet of print media, the system comprising:

an electrophotographic printer operable to print an image on the sheet at a first print speed;

an inkjet color printer operable to print an image on the sheet at a second print speed; and a common housing supporting both the electrophotographic printer and the inkjet printer, the inkjet printer further including a bi-directional sheet advancer operable to controllably move the sheet along an inkjet printer print path in either of first or second opposite directions, an inkjet pen carriage configured to support at least one inkjet pen and movable in a scan direction transverse to the inkjet printer print path for printing on the sheet, and a registration system operable to register the image printed by the inkjet color printer relative to the image printed by the electrophotographic printer, the registration system including an optical sensor supported by the inkjet pen carriage for movement with the pen carriage along the scan direction, the common housing supporting both the printers such that one of the printers is mounted above the other of the printers.

2. A printing system in accordance with claim 1 and further comprising a staging tray that functions both as an output tray configured to receive the sheet after the sheet has been printed on by the electrophotographic printer, as well as an input tray to the inkjet printer.

3. A printing system in accordance with claim 2 wherein the inkjet printer prints with incremental motion and the electrophotographic printer prints with continuous motion.

4. A printing system in accordance with claim 3 wherein the optical sensor is a linear array optical sensor.

5. A printing system in accordance with claim 4 wherein the registration system is configured to perform dot level registration using the optical sensor.

6. A printing system in accordance with claim 5 wherein the electrophotographic printer is configured to print a registration mark on the sheet, wherein the registration system is configured to use the optical scanner to locate the registration mark and effect registration, and wherein the registration system is configured to cause the inkjet pen carriage to move in the scan direction and cause the sheet advancement system to move the sheet in the inkjet paper path direction until the registration mark is located using the optical sensor, prior to printing by the inkjet printer.

7. A printing system for printing on a sheet of print media, the system comprising:

an electrophotographic printer configured to print a black image on the sheet;

an inkjet color printer configured to print a color image on the sheet; and a staging tray that functions both as an output tray configured to receive the sheet after the sheet has been printed on by the electrophotographic printer, as well as an input tray configured to supply the sheet that has been printed on by the electrophotographic printer to the inkjet printer before the inkjet printer prints on the sheet, the inkjet printer further including a bidirectional sheet advancement system configured to controllably move the sheet along an inkjet printer print path in either of a first direction away from the staging tray and a second direction toward the staging tray, an inkjet pen carriage configured to support at least one inkjet pen and movable along a scan direction for printing on the sheet, and a registration system configured to register the image printed by the inkjet color printer relative to the image printed by the electrophotographic printer, the registration system including an optical sensor supported relative to the inkjet pen carriage for movement with the pen carriage along the scan direction.

8. A printing system in accordance with claim 7 wherein the electrophotographic printer is a laser printer.

9. A printing system in accordance with claim 7 wherein the optical sensor is a linear array optical sensor.

10. A printing system in accordance with claim 9 wherein the electrophotographic printer is configured to print a registration mark on the sheet, wherein the registration system uses the optical scanner to locate the registration mark and effect registration, and wherein the registration system causes the inkjet pen carriage to move in the scan direction and causes the sheet advancement system to move the sheet in the inkjet paper path direction until the registration mark is located using the optical sensor, prior to printing by the inkjet printer.

11. A printing system in accordance with claim 10 wherein the registration mark comprises a text character.

12. A printing system in accordance with claim 7 wherein the inkjet printer prints with incremental motion and the electrophotographic printer prints with continuous motion.

13. A printing system in accordance with claim 7 wherein the electrophotographic printer is configured to print at up to a first maximum speed, with respect to pages per minute, and the inkjet printer is configured to print at up to a second maximum speed, with respect to pages per minute, different from the first speed.

14. A method of printing on a sheet of print media, the method comprising:

printing a black image and a registration mark on the sheet with a laser printer, and directing the sheet to a staging tray after the printing with the laser printer;

registering the black image on the sheet in an inkjet color printer that uses a bi-directional sheet feeder to transport the sheet from the staging tray after the sheet has been printed on by the laser printer, the registering including using an optical sensor movable with an inkjet pen carriage, and causing the carriage to move and causing the bidirectional sheet feeder to move until the registration mark is located; and printing a color image on the sheet in the inkjet printer after registering the black image.

15. A method of printing in accordance with claim 14 wherein the registering comprises performing dot level registration.

16. A method of printing in accordance with claim 15 wherein the printing of the registration mark comprises printing a pattern of dots.

17. A method of printing in accordance with claim 14 wherein the registering using an optical sensor comprises using a linear array optical sensor.

18. A method of printing in accordance with claim 14 wherein the printing of the registration mark comprises printing a recognizable pattern.

19. A method of printing in accordance with claim 14 wherein the printing of the color image comprises printing with incremental motion and the printing of the black image comprises printing with continuous motion.

20. A method of printing in accordance with claim 14 wherein the printing of the black image and color image comprises printing using a laser printer and an inkjet printer that are mounted in a common housing.

* * * * *